US008051623B2

(12) United States Patent
Loyd

(10) Patent No.: US 8,051,623 B2
(45) Date of Patent: Nov. 8, 2011

(54) CURTAIN WALL SYSTEM AND METHOD

(75) Inventor: Stephen N. Loyd, Dallas, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 525 days.

(21) Appl. No.: 12/124,647

(22) Filed: May 21, 2008

(65) Prior Publication Data

US 2008/0216444 A1 Sep. 11, 2008

Related U.S. Application Data

(63) Continuation-in-part of application No. 11/074,086, filed on Mar. 7, 2005, now abandoned.

(60) Provisional application No. 60/565,445, filed on Apr. 26, 2004.

(51) Int. Cl.
*E04B 2/88* (2006.01)
*E04G 23/00* (2006.01)

(52) U.S. Cl. ..... 52/747.1; 52/235; 52/489.1; 52/586.2; 52/769

(58) Field of Classification Search ..... 52/235, 52/508, 509, 511, 513, 136, 137, 139, 489, 52/506.06, 586.2, 747.1, 747.11, 489.1, 483.1, 52/489.2, 769, 773
See application file for complete search history.

(56) References Cited

U.S. PATENT DOCUMENTS 2,245,785 A * 6/1941 Jentzer, Jr. ..... 52/416
3,640,043 A * 2/1972 Querfeld et al. ..... 52/508
3,786,605 A * 1/1974 Winfrey ..... 52/235
4,506,482 A * 3/1985 Pracht et al. ..... 52/235
5,265,396 A * 11/1993 Amimoto ..... 52/745.12
5,301,484 A * 4/1994 Jansson ..... 52/235
5,313,760 A * 5/1994 Tojo ..... 52/747.12
5,473,851 A * 12/1995 Northrup, Jr. ..... 52/513
6,098,364 A * 8/2000 Liu ..... 52/506.08
6,170,214 B1 * 1/2001 Treister et al. ..... 52/511
6,202,377 B1 * 3/2001 Krieger ..... 52/489.1
6,792,727 B2 * 9/2004 Krieger ..... 52/245
2003/0150179 A1 * 8/2003 Moreno ..... 52/235
2005/0246983 A1 11/2005 Loyd ..... 52/235

OTHER PUBLICATIONS

*Mexican Patent Office;* OA and English Translation Re: Examination Results; Application PA/a/2006/002573, Ref. 205/025561; Case: 079536.0104; U.S. Appl. No. 11/074,086 Oct. 23, 2009.

* cited by examiner

*Primary Examiner* — Robert Canfield
*Assistant Examiner* — Jessie Fonseca
(74) *Attorney, Agent, or Firm* — Baker Botts L.L.P.

(57) ABSTRACT

A curtain wall system and method comprises supporting channels including vertical receiving and retaining members which engage kerfs formed in the lower edges of curtain wall members. Latching members have locating and retaining members which are received in kerfs form in the upper edges of the curtain wall members. The curtain wall members are rotated inwardly causing the latching members to slide along the under surfaces of the supporting channels and into engagement with locking members. A second embodiment comprises supporting channels and latching members having spaced apart vertically disposed locating members which receive the opposite ends of the curtain wall members. A third embodiment comprises gap filling members which are received between adjacent curtain wall members and comprise hooks located adjacent to the lower ends of the gap filling members for engagement with vertically disposed receiving and retaining members extending upwardly from supporting channels. Latching members located at upper ends of the gap filling members slide along the lower surfaces of the supporting channels and into locking engagement therewith.

9 Claims, 10 Drawing Sheets

CURTAIN WALL SYSTEM AND METHOD

CLAIM OF PRIORITY

This application is a continuation-in-part of application Ser. No. 11/074,086 filed Mar. 7, 2005, now abandoned, the entire contents of which are incorporated herein by reference, which claims priority of prior provisional Application Ser. No. 60/565,445 filed Apr. 26, 2004, the entire contents of which are incorporated herein by reference.

DETAILED DESCRIPTION

Figure 1:
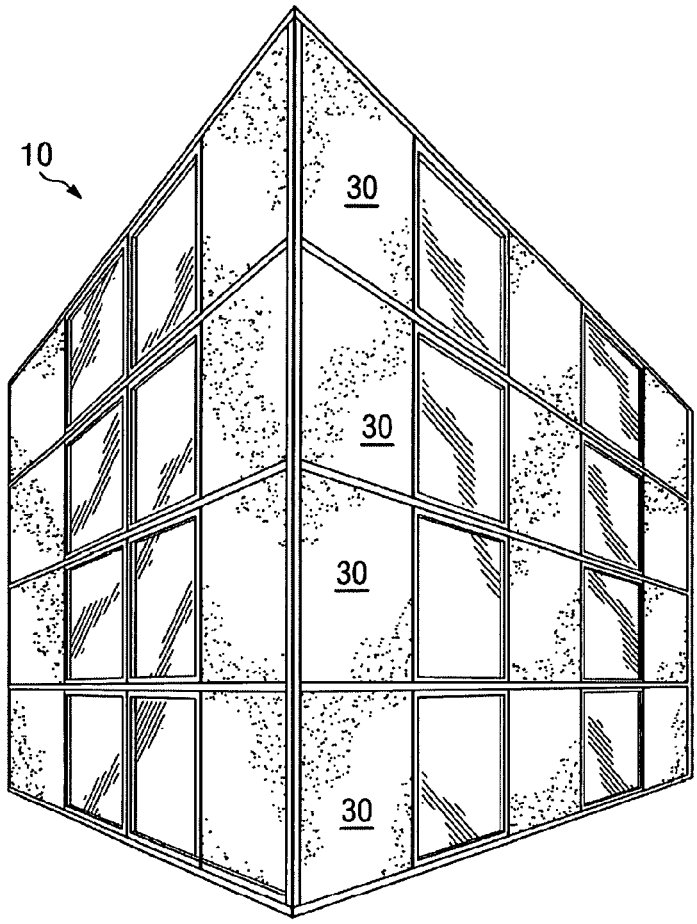
FIG. 1 is an environmental view illustrating a curtain wall system installed in accordance with a first embodiment of the present invention.
Figure 2:
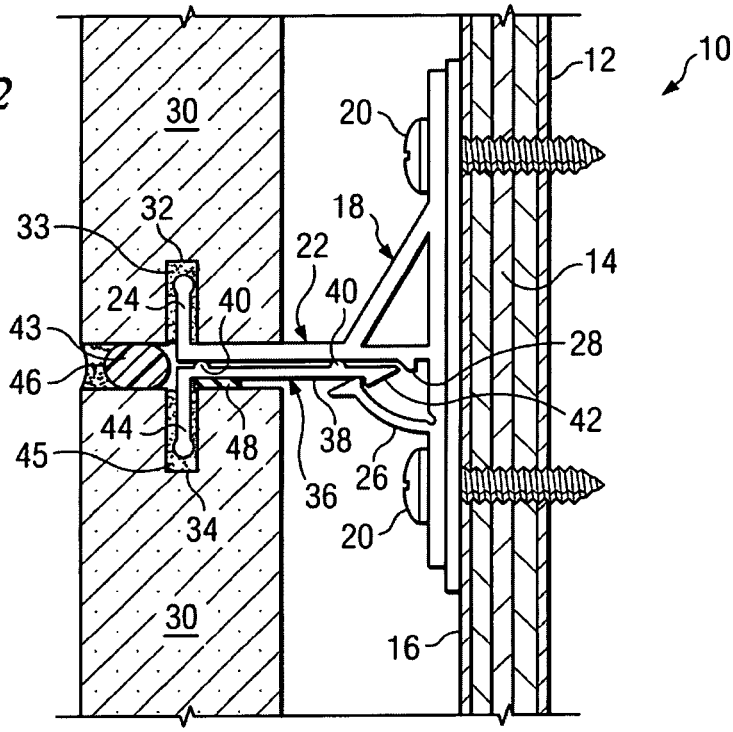
FIG. 2 is an illustration of a curtain wall constructed in accordance with the first embodiment of the present invention.

Referring to FIGS. 1 and 2, there is shown a curtain wall 10 incorporating a first embodiment of the present invention. The curtain wall 10 is supported on a wall 12, which may be comprised of one or more layers of plywood 14. The wall may also comprise steel studs, concrete masonry units (CMOs), concrete, etc. Other construction techniques may be utilized in the fabrication of the wall 12 depending upon the requirements of particular applications of the present invention. The wall 12 may comprise an exterior wall of a building or other structure. In such instances the wall 12 may be provided with a weather proof exterior layer 16 which is fabricated in accordance with conventional techniques.

In accordance with the present invention a plurality of channels 18 are secured to the wall 12 by suitable fasteners 20. The channels 18 may be fabricated from aluminum; however, other materials may be utilized in the fabrication of the channels 18 depending upon the requirements of particular applications of the present invention. A plurality of channels 18 may be positioned adjacent to one another to define a curtain wall support structure which extends substantially the entire width of the wall 12. Alternatively, the channels 18 may be positioned at spaced-apart locations along the width of the wall 12.

Each channel 18 includes a curtain wall supporting member 22, which extends perpendicularly outwardly from the wall 12. A curtain wall receiving and retaining member 24 is located at the distal end of the curtain wall support member 22 and extends perpendicularly upwardly therefrom. The channel 18 is further provided with a locking member 26 and a stop 28.

A plurality of curtain wall members 30 are formed from limestone or other materials. For example, the curtain wall members may be formed from granite, marble, terrazzo, etc. Each curtain wall member 30 has a kerf 32 formed in the lower end thereof and a kerf 34 formed in the upper end thereof.

Following installation, each curtain wall member 30 is supported by the supporting member 22 of the associated channel 18, which is in turn secured to the wall 12 by the fasteners 20. The receiving and retaining member 24 of the channel 18 is received in the kerf 32 of the curtain wall member 30, which is supported on the channel 18. In this manner the curtain wall member 30 is located and positioned relative to the wall 12 by the channel 18. A bed of silicone 33 surrounds and flexibly retains the receiving and retaining members 24.

In accordance with the present invention, latching members 36 are utilized in conjunction with the channel 18. Each latching member 36 includes a horizontally disposed portion 38 which ultimately extends parallel to the supporting member 22 of the channel 18. Knobs 40 formed on the horizontally disposed portion 38 of the latching member 36 maintain proper alignment between the horizontally disposed portion 38 and the supporting member 22.

The horizontally disposed portion 38 of the latching member 36 extends to an arrow-shaped latch 42 positioned for latching engagement with the locking member 26 of the channel 18. The distal end of the latch 42 is positioned closely adjacent to and in alignment with the stop 28 of the channel 18.

A locating and retaining member 44 is located at the opposite end of the horizontally disposed portion 38 of the latching member 36 and extends perpendicularly with respect thereto. The locating and retaining member 44 is received in the kerf 34 situated at the upper end of the corresponding curtain wall member 30 and is retained therein by a quantity of silicone 45 previously received therein. Once two adjoining wall members 30 are secured in place, an open cell backer rod 43 is inserted. Then joint sealant 46 is applied between the wall members 30 to seal against moisture penetration, to provide additional strength and stability to the wall members, and to provide a cushion allowing some movement by the wall members 30 due to wind load, foundation settlement, earthquakes, hurricanes, and the like.

Figure 3:
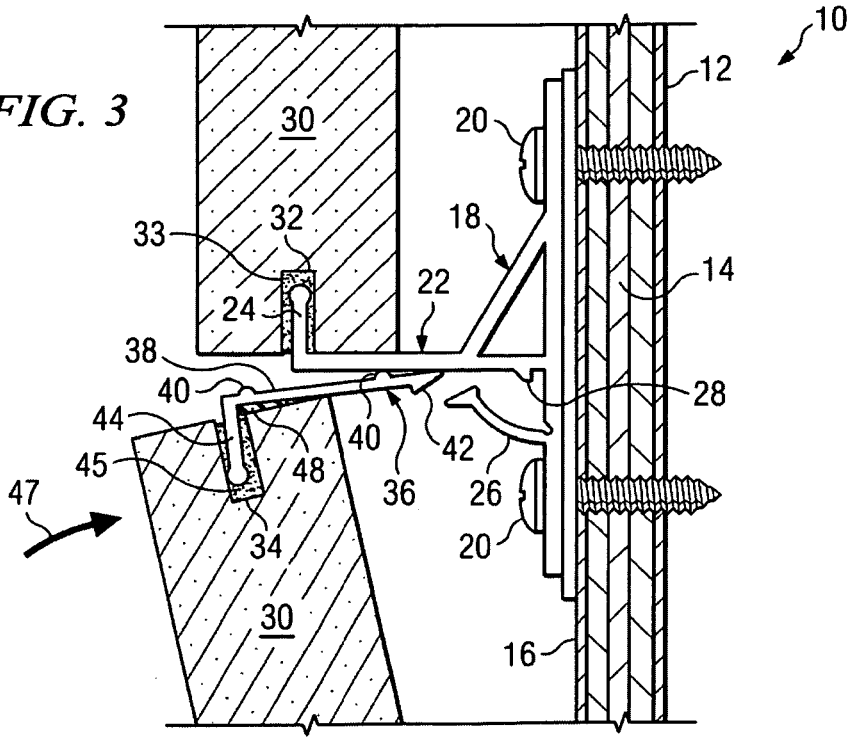
FIG. 3 is an illustration of the curtain wall installation method in accordance with the first embodiment of the present invention.

A method of curtain wall installation comprising a first embodiment of the present invention is illustrated in FIG. 3. An upper curtain wall member 30 is first supported on a channel 18 constructed in accordance with the present invention with the receiving and retaining member 24 received in the kerf 32 thereof and with the upper curtain wall member supported on the curtain wall supporting member 22. The latching member 36 is engaged with a lower curtain wall member 30 by positioning the locating and retaining member 44 thereof in the kerf 34 of the lower curtain wall member 30. The locating and retaining member 44 is flexibly retained in the kerf 44 by the quantity of silicone 45.

The lower curtain wall member 30 is then rotated inwardly toward the channel 18 in the direction of the arrow 47. As the lower curtain wall member 30 rotates into position the arrow-shaped latch 42 of the latching member 36 rotates downwardly and moves past the locking member 26 of the channel 18, thereby securing the lower curtain wall member 30 in place. Further inward movement of the lower curtain wall member 30 is prevented by engagement of the distal end of the latch 32 with the stop 28 of the channel 18.

Foam tape 48 secured beneath the proximal end of the horizontally disposed member 38 compresses to allow the latching member 36 and the arrow-shaped latch 42 to rotate into the locking member 26 of the channel 18. Once the latching member 36 is locked in place in the locking member 26, the foam tape 48 decompresses thereby holding the latching member 36 snugly against the support member 22 until the joint sealant 48 sets to permanently hold the latching member 36 in place.

Figure 4:
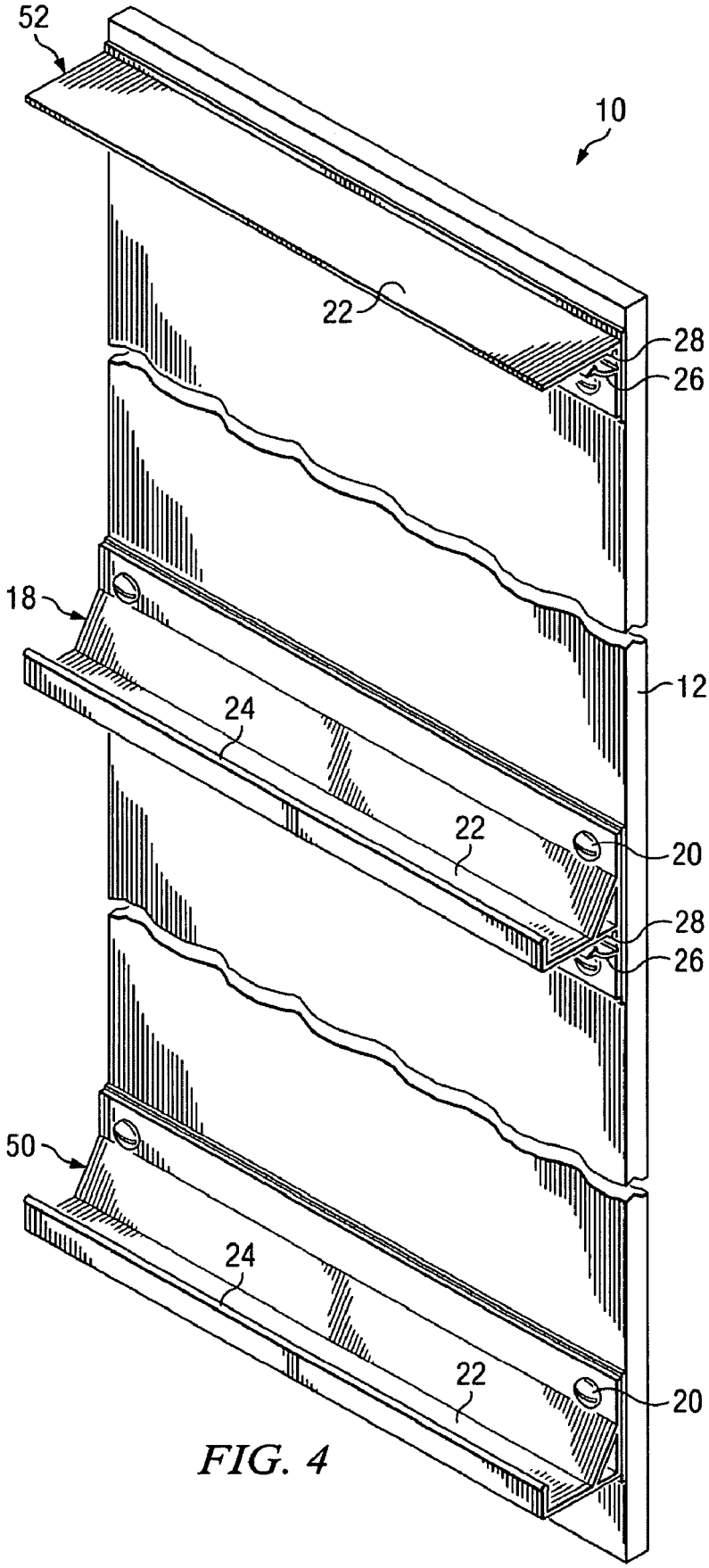
FIG. 4 is a perspective view illustrating an initial step in the utilization of the curtain wall installation method comprising the first embodiment of the first embodiment of the present invention.

FIG. 4 illustrates the preliminary step of the curtain wall installation method comprising the first embodiment of the present invention. Channels 18 are secured to the wall 12 by suitable fasteners 20 at vertically spaced intervals substantially equal to the height of each wall member 30. At the base of the wall a bottom channel 50 is mounted to receive a lower-most wall member 30 to be mounted on the wall 12. The bottom channel 50 is substantially similar in construction to the channel 18 but comprises only a support member 22 and a receiving and retaining member 24 on the distal end thereof. A top channel 52 is mounted to receive the uppermost wall member 30 to be mounted on the wall 12. The top channel is similar in construction to the channel 18 but comprises only a support member 22, a stop 28, and a locking member 26.

Figure 5:
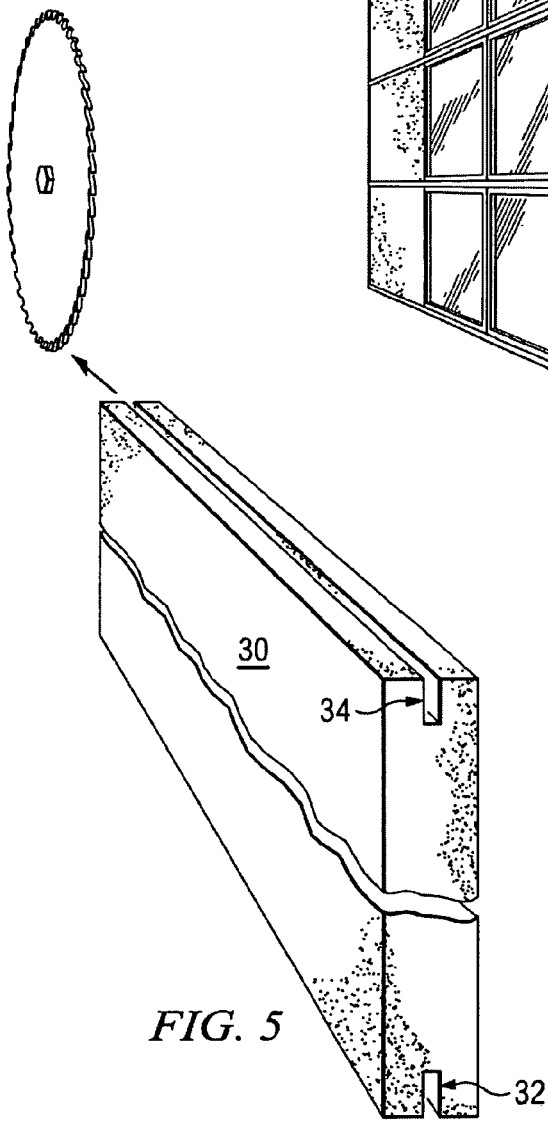
FIG. 5 is a perspective view illustrating a later step in the utilization of the curtain wall installation method comprising the first embodiment of the present invention.
Figure 6:
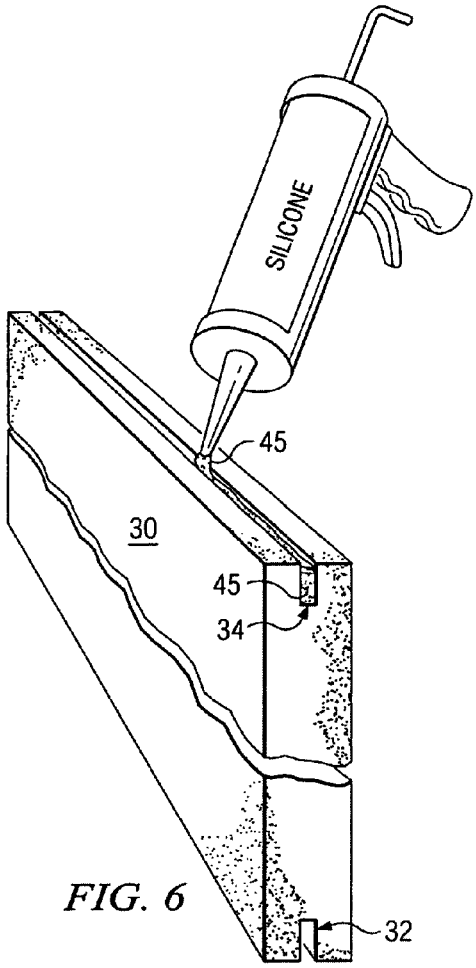
FIG. 6 is a perspective view illustrating a somewhat later step in the utilization of the curtain wall installation method comprising the first embodiment of the present invention.
Figure 7:
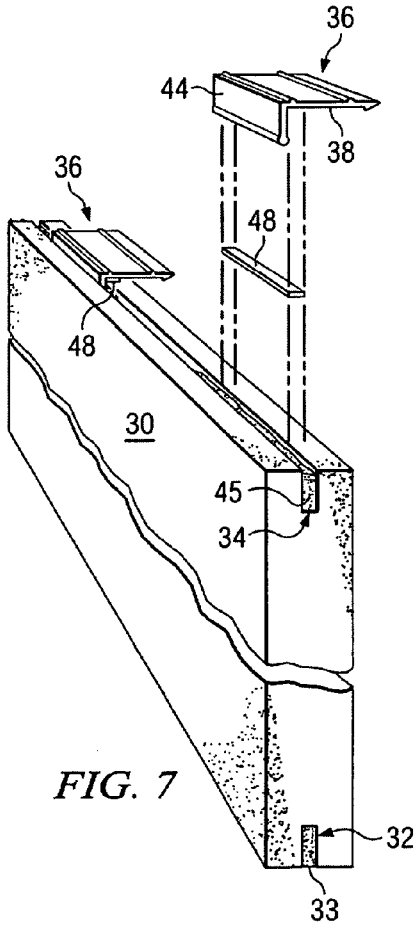
FIG. 7 is a perspective view illustrating a still later step in the utilization of the curtain wall installation method comprising the first embodiment of the present invention.

Referring now to FIGS. 5 through 7, there is shown the next steps in the curtain wall installation method comprising the first embodiment of the present invention which prepares the wall member 30 for mounting. As best shown in FIG. 5, kerfs 32 and 34 are formed in the lower and upper ends of the wall member 30. Silicone 45 is applied into the kerfs 34 as shown in FIG. 6, and silicone 33 is similarly applied into the kerfs 32. As best shown in FIG. 7, once the silicone is applied, foam tape 48 is secured below the distal end of the horizontally disposed portion 38 of the latching member 36 after which the locating and retaining member 44 is inserted into the kerf 32 in the upper end of the wall member 30. The locating and retaining member 36 is flexibly secured in the kerf 34 by the silicone received therein.

Figure 8:
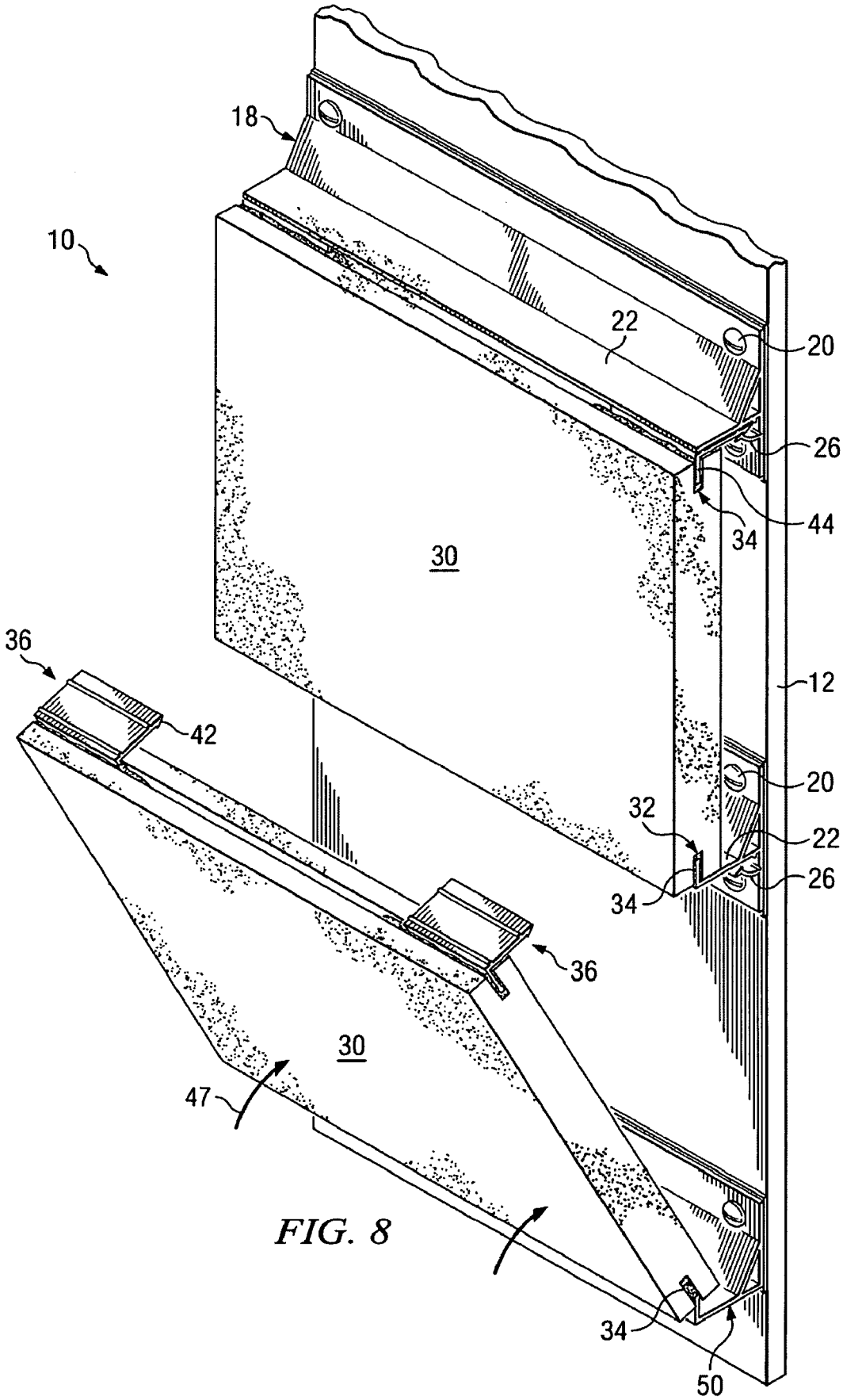
FIG. 8 is a perspective view illustrating an even later step in the utilization of the curtain wall installation method comprising the first embodiment of the present invention.
Figure 9:
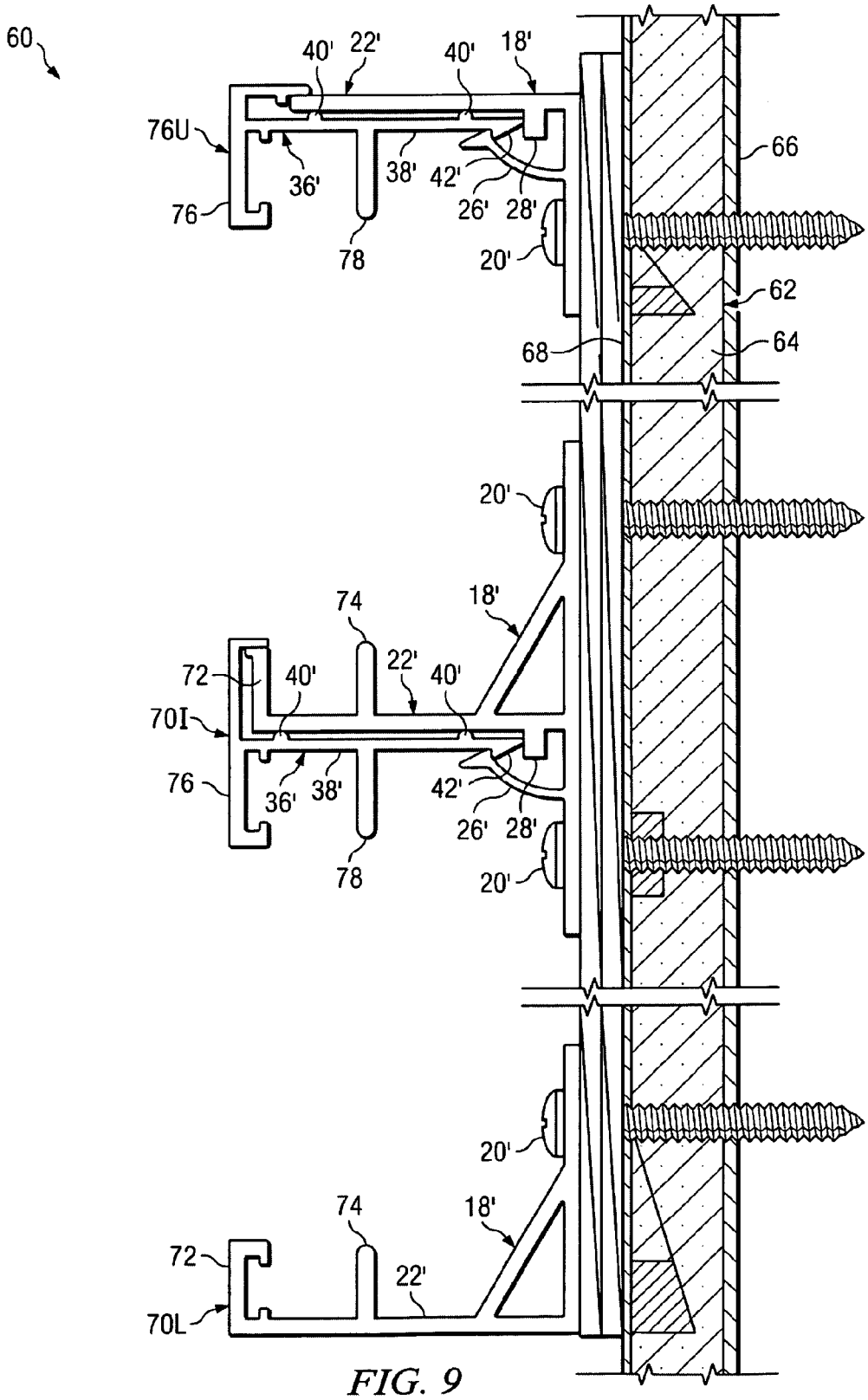
FIG. 9 is a sectional view illustrating a second embodiment of the present invention.

Referring now to FIG. 8, the wall members 30 are installed beginning at the top of the wall 12 and proceeding downward therefrom. Once the wall member 30 is prepared, the silicone filled kerf 34 at the lower end of a wall member 30 receives the receiving and retaining member 24 of the support member 22 located near the lower end of the wall member 30. The wall member 30 is then rotated inwardly toward the channel 18 in the direction of the arrow 47. As the lower curtain wall member 30 rotates into position, the arrow-shaped latch 42 of the latching member 36 moves past the locking member 26 of the channel 18 thereby securing the lower curtain wall member 30 in place. Once the curtain wall members 30 are in place an open cell backer rod 43 and then silicon sealant 46 are placed between the wall members 30.

The first embodiment of the present invention is illustrated in conjunction with the construction of curtain walls wherein the wall members 30 are formed of limestone, stone, and other like materials. However, the present invention is equally applicable to constructing walls comprising tile, porcelain, wood and various other materials used for wall curtains both on interior and exterior walls.

A curtain wall 60 comprising a second embodiment of the present invention is illustrated in FIGS. 9 through 12, inclusive. The curtain wall 60 includes various component parts which are substantially identical in construction and function to component parts of the curtain wall 10 illustrated in FIGS. 1 through 8 and described hereinabove in conjunction therewith. Such identical component parts are identified in FIGS. 9 through 12 with the same reference numerals utilized above in the description of the curtain wall 10. The curtain wall 60 differs from the curtain wall 10 in that the curtain wall 60 is designed and intended for use with relatively light weight curtain wall members fabricated from materials such as travertine stone, tile, composite materials, and the like.

The curtain wall 60 is supported on a wall 62 comprising a central core 64 and internal layer 66 and an external layer 68. The wall 62 may comprise an exterior walling of a building or other structure. In such instances, the wall 62 may be provided with a weather proof exterior layer which is fabricated in accordance with conventional techniques.

In accordance with the second embodiment of the present invention, a plurality of channels 18' are secured to the wall 62 by suitable fasteners 20'. The channels 18' may be fabricated from aluminum; however, other materials may be utilized in the fabrication of the channels 18' depending upon the requirements of particular applications of the present invention. A plurality of channels 18' may be positioned adjacent to one another to define a curtain wall support structure which extends substantially the entire width of the wall 62. Alternatively, channels 18' may be positioned at spaced apart locations along the width of the wall 62.

The channels 18' comprise three different types including a plurality of upper channels 70U, a multiplicity of intermediate channels 701, the exact number of which depends on the height of the curtain wall 60 and a plurality of lower channels 70L. The intermediate channel assembly 701 each includes a channel 18' having a pair of curtain wall member locators 72 and 74 extending vertically upwardly from the supporting member 22'. The latching member 36' similarly has a pair of curtain wall member locators 76 and 78 which extend downwardly from the horizontally disposed portion 38' of the latching member 36'. The locating member 76 extends upwardly from the horizontally disposed portion 38' and over the top of the curtain wall member locator 72 of the channel 18' to provide a pleasing appearance at the joints between adjacent curtain wall members.

The upper channels 70U differ from the immediate channels 701 in that the curtain wall member locators 72 and 74 are omitted and the upper portion of the curtain wall member locator 76 is configured to engage the distal end of the supporting member 22'. The lower curtain wall channels 70L include the curtain wall member locators 72 and 74, but the components of the intermediate channels 701 associated with the latching members 36' are omitted.

Figure 10:
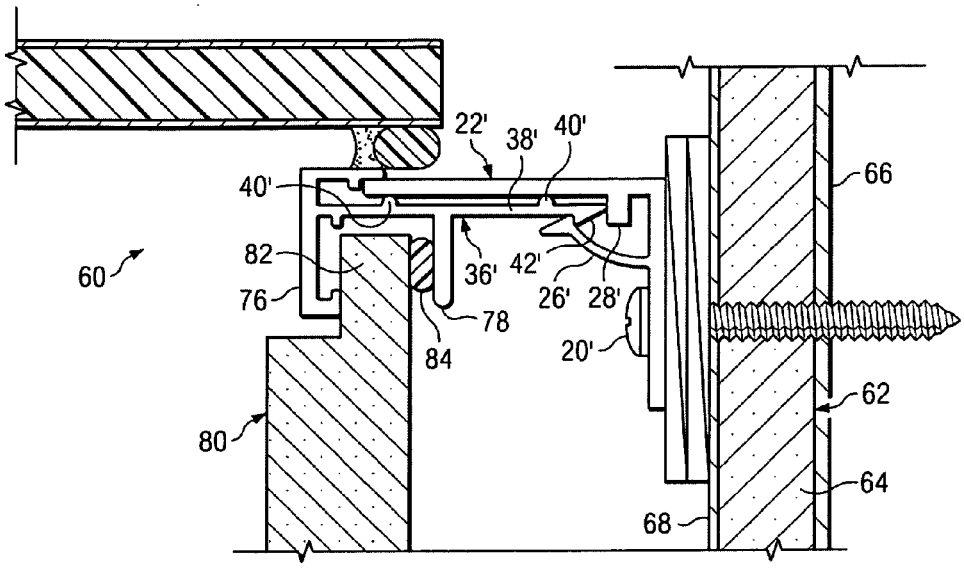
FIG. 10 is an enlargement of the upper portion of FIG. 9.
Figure 11:
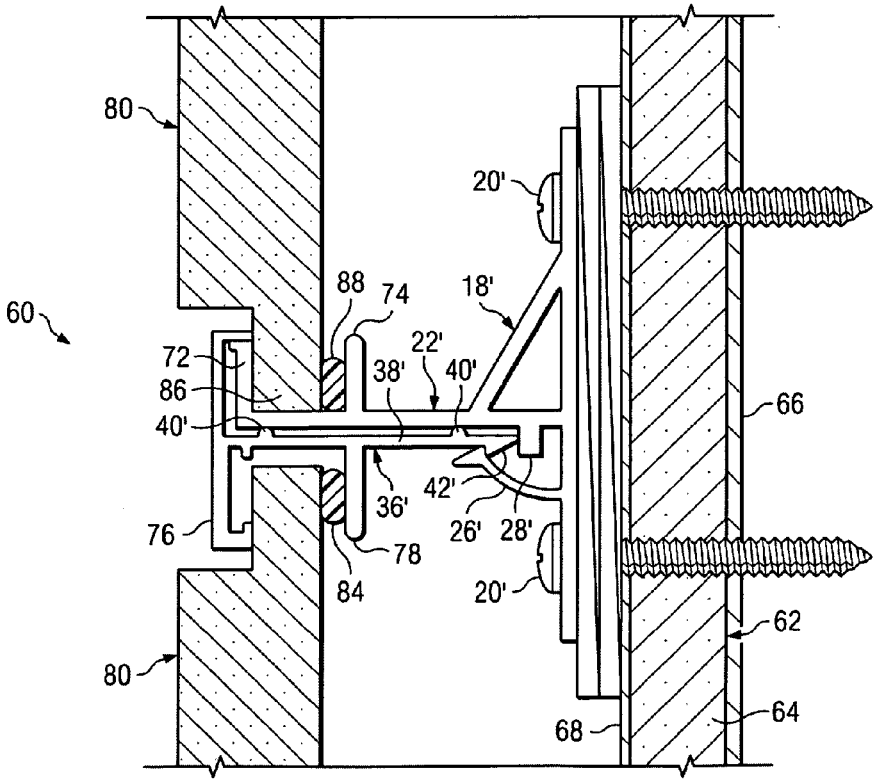
FIG. 11 is an enlargement of the intermediate portion of FIG. 9.
Figure 12:
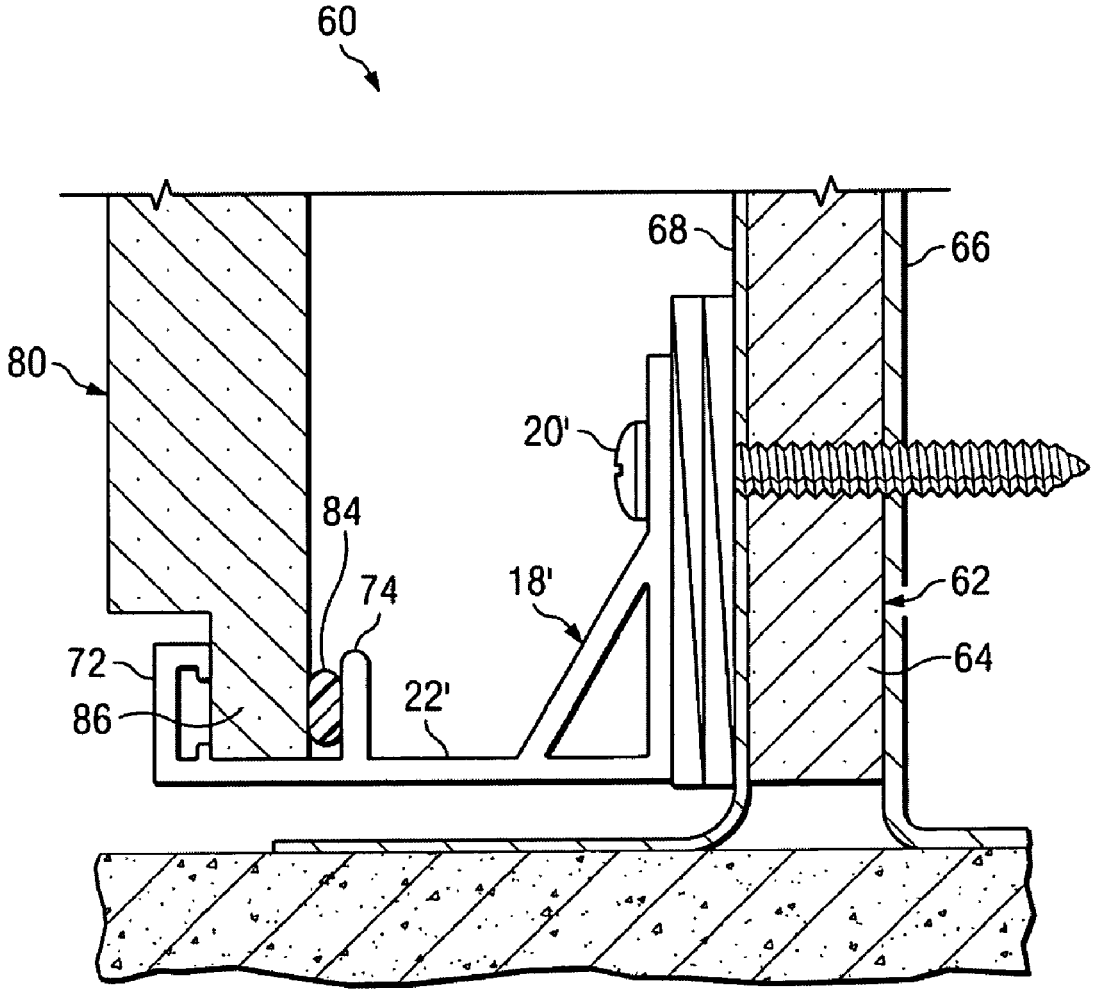
FIG. 12 is an enlargement of the lower portion of FIG. 9.

FIGS. 10, 11 and 12 illustrate the curtain wall system 60 having curtain wall members 80 installed therein. Each of the curtain wall members 80 has a relieved portion 82 at the upper end thereof which is received within and located by the locators 76 and 78 of the latching member 36'. A bead of silicone 84 is positioned between each relieved portion 82 and the locator 78 to secure the curtain wall member 80 against movement relative to locators 76 and 78. The lower end of each curtain wall member 80 is relieved at 86 and is received between the locators 72 and 74. A bead of silicone 88 is positioned between the lower relieved portion 82 of the curtain wall member 80 and the locator 74 to prevent movement of the curtain wall member 80 relative to the locators 72 and 74.

The curtain wall members 80 of the curtain wall system 60 are installed similarly to the installation of the curtain wall members 30 of the curtain wall system 10 as illustrated in FIG. 8 and described hereinabove and in conjunction therewith. The installation of each curtain wall member 80 begins with engagement of the lower relieved portion 86 between the locators 72 and 74 of one of the supporting members 22', it being understood that the silicone bead 88 is installed before the curtain wall member 80 is engaged between the locators 72 and 74. The relieved portion 82 at the upper end of the curtain wall member 80 receives the latching member 36' thereon, it being understood that the silicone bead 78 is installed prior to the installation of the curtain wall member 80.

After the relieved portion 86 has been engaged between the locators 72 and 74, the curtain wall member 80 is rotated inwardly toward the channel 22'. As the curtain wall member 80 moves into position, the arrow-shaped latch 42' moves past the locking member 26' of the channel 18', thereby securing the curtain wall member 80 in place. Before the curtain wall member 80 is secured in place, the silicone beads 78 and 88 are installed between the relieved portions 82 and 86 of the curtain wall member and the adjacent locators 76 and 78 and 72 and 74, respectively.

Figure 13:
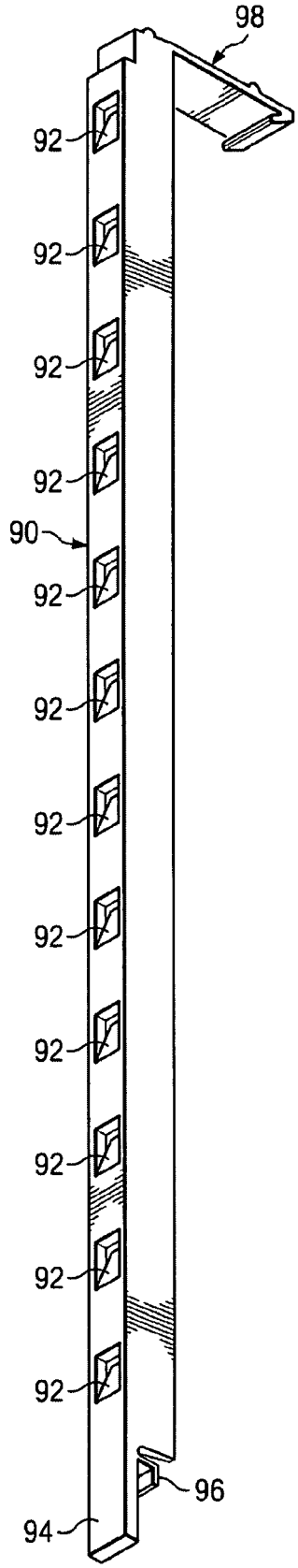
FIG. 13 is a perspective view illustrating a third embodiment of the present invention.
Figure 14:
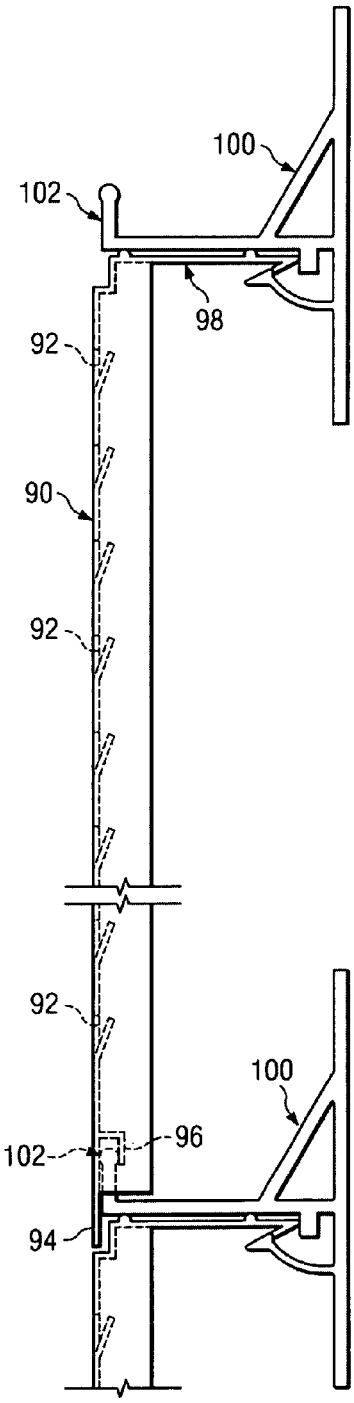
FIG. 14 is a side view further illustrating the third embodiment of the present invention.
Figure 15:
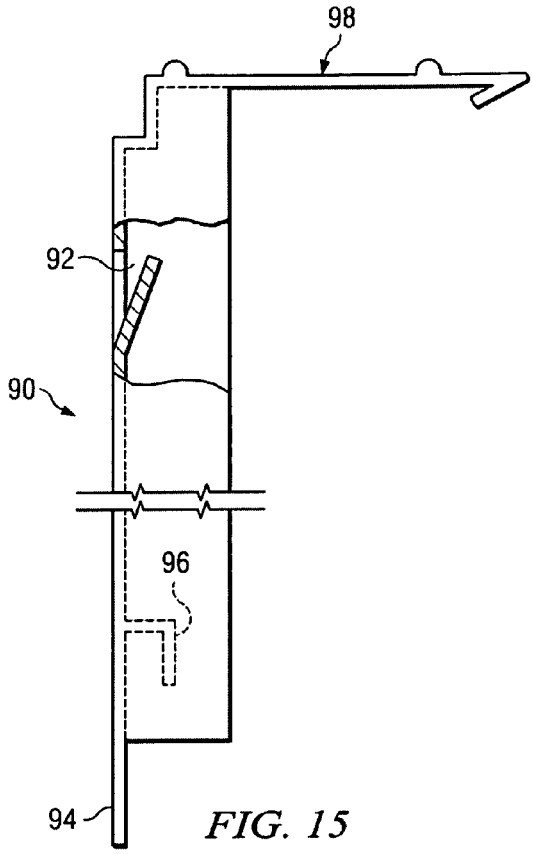
FIG. 15 is an enlargement of a portion of FIG. 14.

A third embodiment of the present invention comprising a system for closing the joints between adjacent curtain wall members is illustrated in FIGS. 13 through 15, inclusive. As is well-known current systems for filling the gaps between adjacent curtain wall members comprise use of either grout or plastic materials such as silicone. Utilization of either of the existing systems can result in difficulties caused by pressure differentiations on opposite sides of curtain wall members.

Referring particularly to FIG. 13 there is shown a mechanism for filling gaps between adjacent curtain wall billing members which eliminates the foregoing and other difficulties which have long since characterized the prior art. In accordance with the third embodiment of the present invention, a gap filling member 90 formed from a suitable plastic material is provided with a plurality of vents 92 which eliminate the possibility of pressure differentiation on opposite sides of a curtain wall member.

The lower end of the gap filling member 90 includes an extension 94 useful in hiding horizontal gaps which would otherwise be readily observable when gap filling members 90 are positioned one above the other. The lower end of the gap filling member 90 further includes a hook 96 useful in securing the gap filling member 90 against dislocation. The upper end of the gap filling member 90 comprises a latching member 98 which is substantially identical in construction and function to the latching members 36 and 36' described hereinabove in connection with the curtain wall members 30 and 80.

Referring to FIG. 14, receiving and supporting members 100, which are substantially identical in construction and function to the receiving members 22 and 22' described hereinabove and in conjunction with the first and second embodiments of the present invention include a vertically extending retainer 102. The retainer 102 receives the hook 96 of the gap filling member 90, thereby supporting the weight of the gap filling member 90.

The gap filling member 90 is installed between adjacent curtain wall members by first engaging the hook 96 thereof with an appropriate retainer 102. The gap filling member 90 is then rotated inwardly toward the supporting and positioning member 100 as gap filling member 90 moves into position the arrow-shaped latch at the distal end of the latching member 104 moves past the locking member of the receiving and supporting member 100 thereby securing the gap filling member 90 in place. As pointed out above, the vents 92 of the gap filling member 90 eliminate pressure differentiation on opposite sides of the curtain wall members which extend adjacent to the gap filling member 90.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A method, comprising:

substantially filling first and second kerfs of a curtain wall member with silicone, the first and second kerfs in upper and lower ends, respectively, of the curtain wall member;

embedding a locating-and-retaining member of a latching member in the silicone in the first kerf, the latching member comprising a nominally horizontally-disposed portion having first and second ends, the locating-and-retaining member located at the first end of the horizontally-disposed portion and extending downwardly with respect to the horizontally-disposed portion, the horizontally-disposed portion of the latching member positioned such that foam tape beneath the horizontally-disposed portion is positioned in engagement with the upper end of the curtain wall member;

embedding a receiving-and-retaining member of a first curtain wall member supporting channel in the silicone in the second kerf such that the curtain wall member initially extends upwardly and angularly outwardly relative to the first curtain wall member supporting channel, a second curtain wall member supporting channel positioned above and substantially parallel to the first curtain wall member supporting channel; and rotating the curtain wall member inwardly toward the second curtain wall member supporting channel such that the second end of the horizontally-disposed portion of the latching member slides along a lower surface of a supporting member of the second curtain wall member supporting channel causing the latching member to rotate downwardly, compressing the foam tape, the second end of the latching member sliding along the lower surface of the second curtain wall member supporting channel moving past a locking member disposed beneath the lower surface of the supporting member of the second curtain wall member supporting channel until a latch at the second end of the latching member comes into latching engagement with the locking member, the foam tape beneath the horizontally-disposed portion of the latching member decompressing once the latch comes into latching engagement with the locking member and maintaining the latching member in engagement with the lower surface of the supporting member of the second curtain wall member supporting channel to facilitate holding the latching member in place.

2. The method of claim 1, comprising rotating the latching member such that the latch of the latching member comes out of latching engagement with the locking member disposed beneath the lower surface of the supporting member, the latching member compressing the foam tape, the second end of the latching member adapted to slide along the lower surface of the second curtain wall member supporting channel moving outward past the locking member until the latching member is released.

3. The method of claim 1, wherein:

the first and second curtain wall member supporting channels are part of a vertical array of channels comprising at least one additional channel, the channels of the vertical array of channels being substantially parallel to one another;

the curtain wall member is one of a plurality of curtain wall members all substantially equal in height.

4. The method of claim 3, wherein a channel in the vertical array of channels comprises a top channel, the top channel comprising a top bracket and a stop for receiving an upper-level curtain wall member, the top bracket comprising a locking member.

5. The method of claim 3, wherein a channel in the vertical array of channels comprises a bottom channel, the bottom channel comprising a bottom bracket for receiving a lower-level curtain wall member, the bottom bracket comprising a supporting member and a receiving-and-retaining member.

6. The method of claim 1, wherein the second curtain wall member supporting channel is separated from the first curtain wall member supporting channel by a distance substantially equal to the height of the curtain wall member.

7. The method of claim 1, wherein the receiving-and-retaining member of the first curtain wall member supporting channel is located at and extends vertically upward from the first end of the supporting member of the first curtain wall member supporting channel.

8. The method of claim 1, comprising mounting the first and second curtain wall member supporting channels directly to a wall of a structure.

9. The method of claim 1, wherein the first and second curtain wall member supporting channels are secured to a wall of a structure with one or more intervening layers of material between the first and second curtain wall member supporting channels and the wall.

* * * * *